United States Patent [19]

Jung

[11] 4,395,960

[45] Aug. 2, 1983

[54] POCKET POSITIONING APPARATUS

[75] Inventor: Wilhelm H. Jung, Mechanicsville, Va.

[73] Assignee: AMF Incorporated, White Plains, N.Y.

[21] Appl. No.: 303,746

[22] Filed: Sep. 21, 1981

[51] Int. Cl.[3] ..... D05B 21/00; D05B 3/00

[52] U.S. Cl. ..... 112/121.15; 112/70; 112/163; 112/265.1

[58] Field of Search ..... 112/121.15, 121.12, 112/65, 70, 163, 167, 104, 265.1, 262.1

[56] References Cited

U.S. PATENT DOCUMENTS

| | | | |
|---|---|---|---|
| 3,653,345 | 4/1972 | Bianchi | 112/65 |
| 3,795,946 | 7/1973 | Bianchi | 112/65 |
| 3,797,422 | 3/1974 | Sakawa | 112/70 |
| 3,911,838 | 10/1975 | Nelli | 112/70 |
| 4,043,283 | 8/1977 | Jung | 112/163 |
| 4,079,681 | 3/1978 | Bianchi | 112/121.15 |
| 4,096,810 | 6/1978 | Bianchi | 112/65 |

*Primary Examiner*—H. Hampton Hunter

*Attorney, Agent, or Firm*—David E. Dougherty; Charles J. Worth

[57] ABSTRACT

Apparatus in conjunction with a twin needle tacker to facilitate loading and simultaneously tacking both ends of a rear or hip pocket opening.

8 Claims, 5 Drawing Figures

POCKET POSITIONING APPARATUS

This invention relates generally to sewing machines and more particularly to means for adapting a twin needle tacker to perform a particular task.

Up to this time the normal manner of reinforcing the ends of a rear or hip pocket is to provide a tack with a single needle tacker at one end of the opening and repositioning the garment to provide a tack at the other end. Tacking the corners of patch pockets is accomplished in the same manner. The need for speed and efficiency of sewing operations is well established. Obviously, if a pair of tacks can be made simultaneously, the overall efficiency in making a garment is greatly increased and the manufacturing time is substantially reduced.

Twin needle tacking is not new as disclosed by my U.S. Pat. No. 4,043,283 which is made part of the present application by reference thereto. This patent primarily discloses a twin needle tacker with means for adjusting the interspace between the needles and the associated cooperating parts. The invention of the foregoing patent was basically conceived for simultaneously providing parallel tacks of equal length at both ends of a belt loop and embodies a programmed clamp assembly comprising a feed plate and clamping jaws for appropriately moving a belt loop and garment in unison during the tacking operation.

While the present invention is not directed to belt loop tacking, the sewing apparatus and means for holding and feed work at the sewing or stitching station is generally similar to the apparatus of the aforenoted U.S. Pat. No. 4,043,283. Of primary concern is means to facilitate loading the sewing station and appropriately positioning the work thereat, and thereafter simultaneously tacking both ends of a back or hip pocket opening. Although, separate pieces of cloth are not involved, the adjustable interspace between the needles is in the range of $4\frac{3}{4}''$ to $5\frac{3}{4}''$. With this degree of spread it should be appreciated that appropriate alignment of the ends of a pocket opening without assistance is difficult and time consuming.

Accordingly, an object of the present invention is to provide means to facilitate loading a twin needle tacker for simultaneously tacking both ends of a pocket opening.

Another object of the present invention is to provide the foregoing apparatus in conjunction with appropriate work holding and feeding means.

Still another object of the present invention, is to provide the foregoing means to facilitate loading which can be retracted from the sewing station after the work is retained by the work holding and feeding means.

And another object of the present invention is to provide a twin needle tacker having a programmed clamping and work moving means with a work loading guide which is retracted or withdrawn from the sewing station prior to tacking.

The foregoing and other objects and advantages will be more fully understood hereinafter from a consideration of the detailed description which follows taken together with the accompanying drawings wherein a single embodiment is illustrated by way of example. It is to be expressly understood, however, that the drawings are for illustration purposes only and are not to be construed as defining the limits of the present invention.

Figure 1:
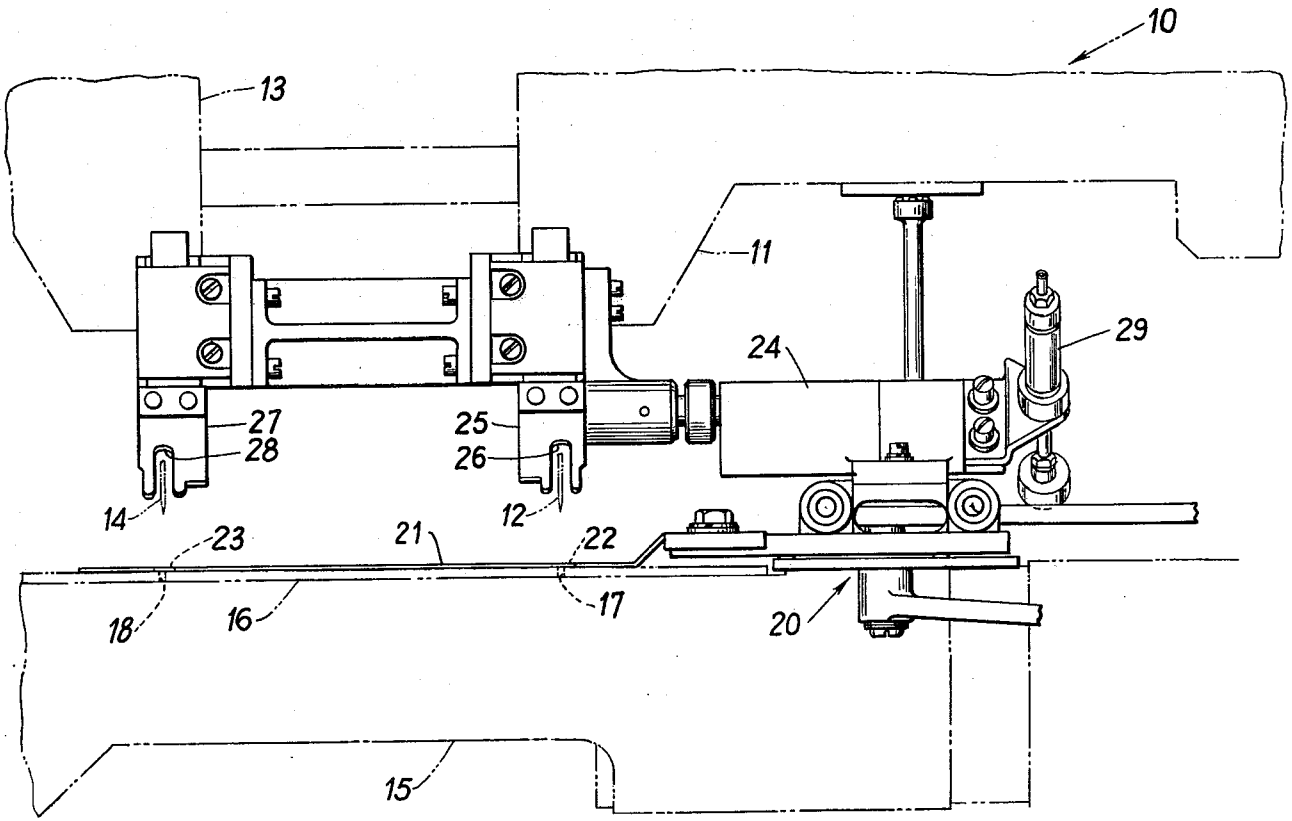
FIGS. 1 and 2 are front and end elevational views, respectively, of the clamping apparatus which moves the garment during tacking.
Figure 5:
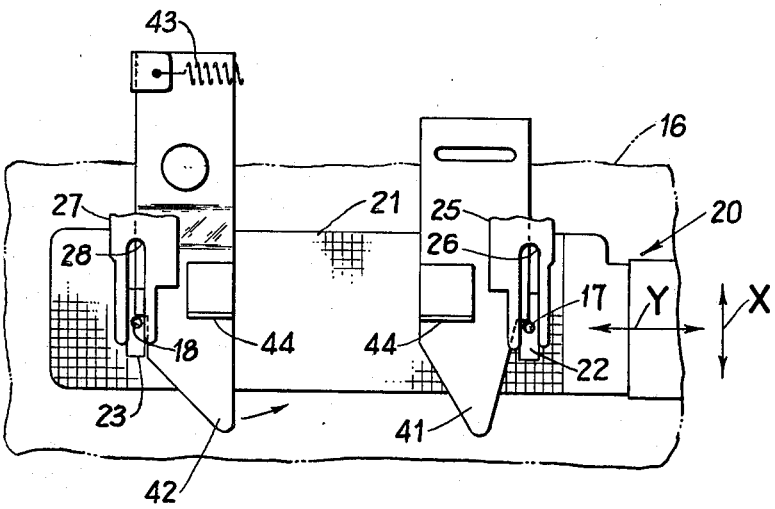
FIG. 5 is a plan view of the garment engaging apparatus of FIGS. 1 to 4.
Figure 3:
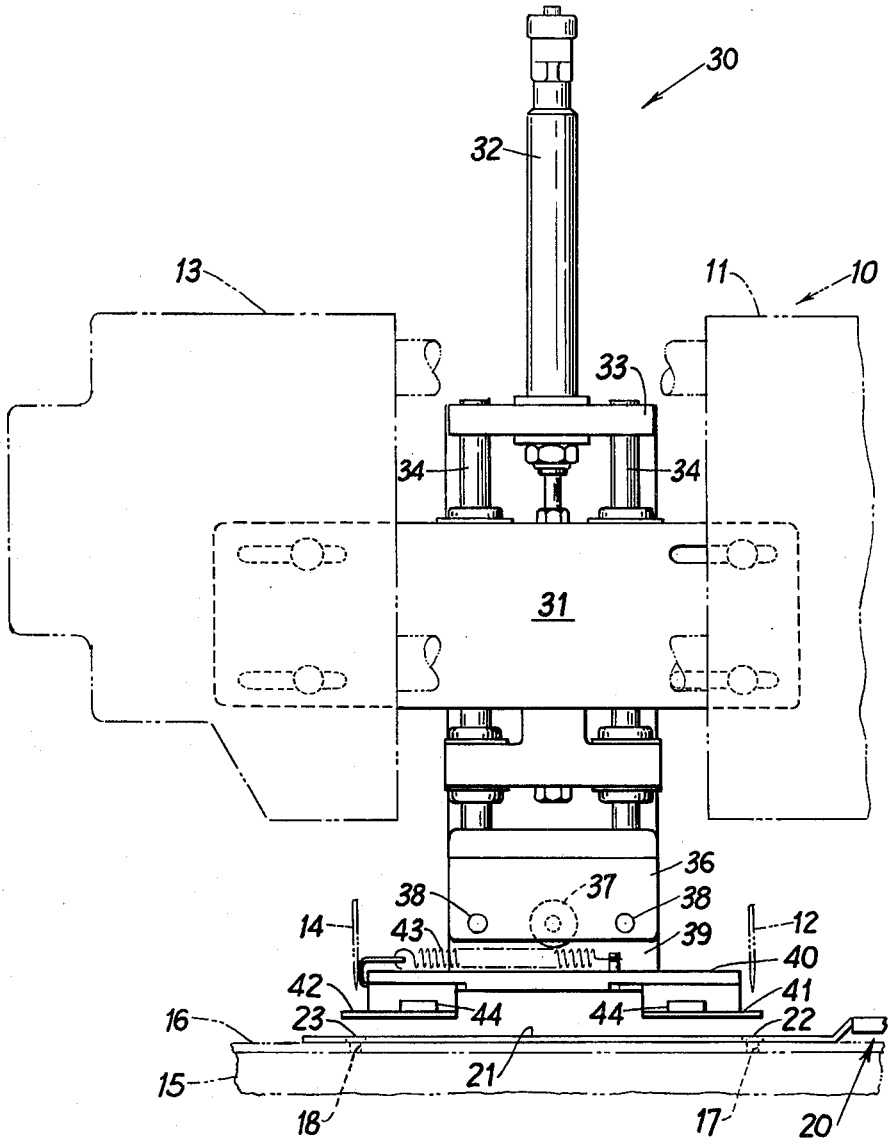
FIGS. 3 and 4 are front and end elevational views, respectively, of the novel guide and loading apparatus.

The operator will be positioned in front of the machine as viewed in FIGS. 1 and 3, and the length of the tacks will be considered as extending longitudinally while the width of such tacks result from lateral movement, as indicated by arrows X and Y, respectively, in FIG. 5.

Figure 2:
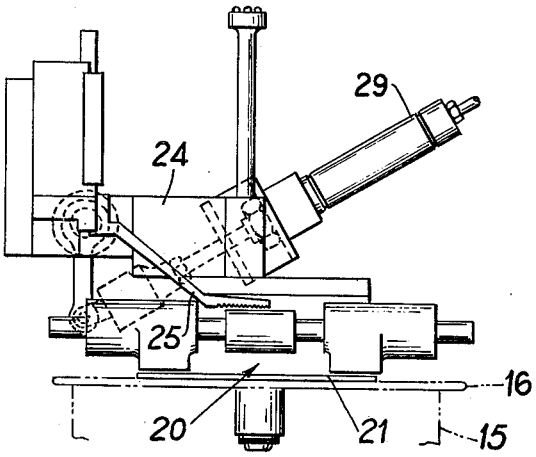

Referring now to the drawings and particularly to FIGS. 1 and 2, a sewing machine 10 is provided with a main or inner end housing or head portion 11 enclosing generally conventional drive means and needle bar (not shown) for a needle 12, and a secondary, or outer end housing or head portion 13 and enclosing similar drive means and needle bar (not shown) for a needle 14. The end housing 13 may be adjusted toward and away from end housing 11 to vary the space between the needles 12 and 14, as may be required.

The machine 10 is also provided with a lower or bed frame 15 housing the usual bobbins, shuttles and drive therefor and a throat plate 16 having a pair of spaced needle holes 17 and 18, the spacing of which can be changed in any suitable manner, for example, as set forth in U.S. Pat. No. 4,043,283.

Also generally similar to structure of the aforenoted patent, a drive means 20 is provided to move a feed plate 21 along a longitudinal axis X and a lateral axis Y. The feed plate 21 is provided with a pair of spaced slots 22 and 23 aligned with needle holes 17 and 18, respectively. A clamp assembly 24 is provided with a pair of presser or gripper feet 25 and 27 with the usual needle slots 26 and 28, respectively, which are aligned with needle holes 17 and 18, of the throat plate 16. A motor or drive means 29 is provided to rotatively move the presser or gripper feet 25 and 27 in unison to a retracted position spaced from the feed plate 21 while a garment is being properly positioned for tacking, and to an active extended position clamping a garment against the feed plate 21 during the sewing or tacking operation. From the foregoing, it should be readily understood that the sewing machine 10 and its components, the drive means 20 with feed plate 21, and the clamp assembly 24 and its components generally correspond to equivalent apparatus of U.S. Pat. No. 4,043,283.

Figure 4:
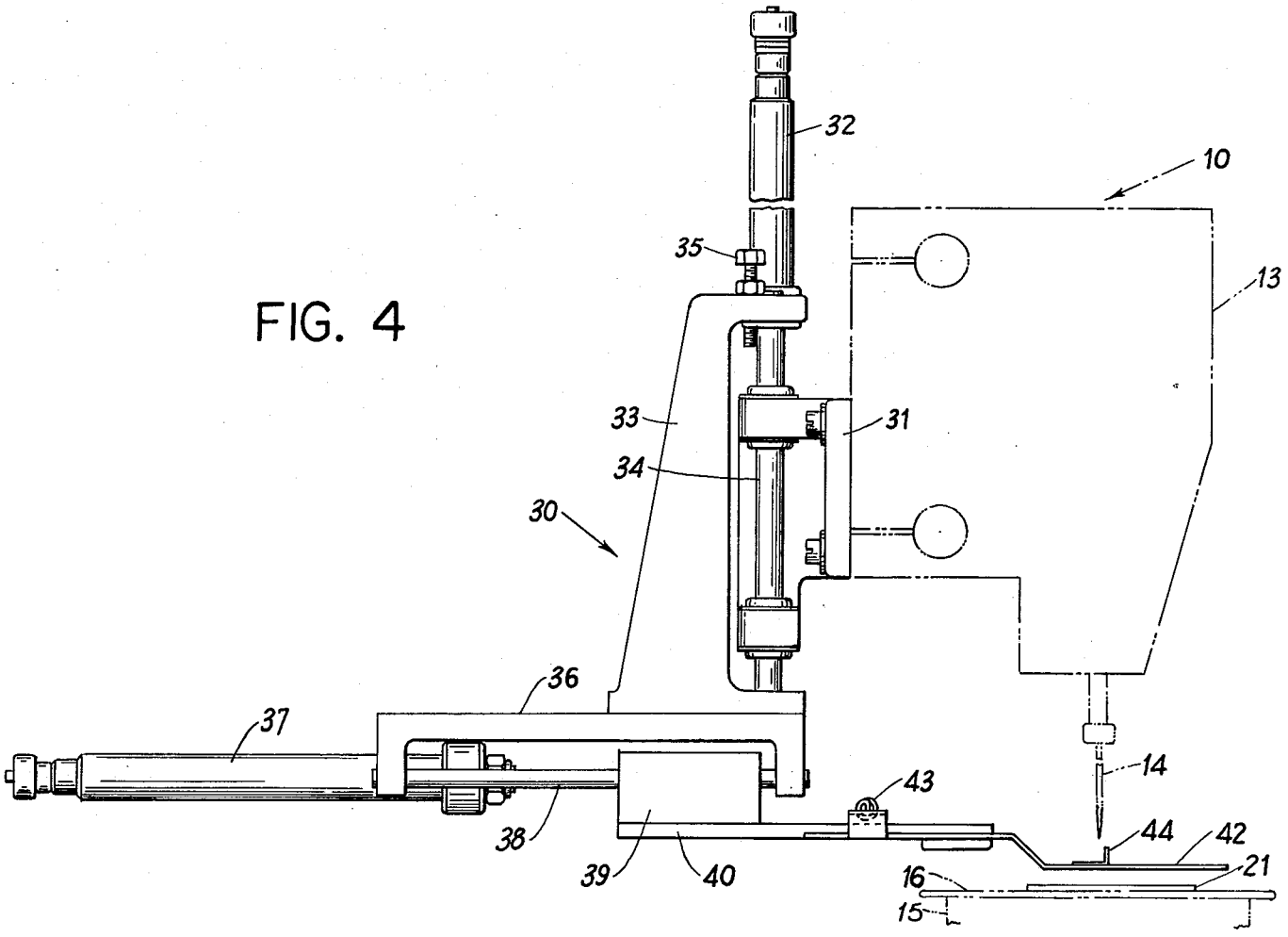

Referring now particularly to FIGS. 3 and 4, a novel pocket positioning means 30 is provided with a bracket 31 connected to the head ends 11 and 13 by any suitable fasteners and is provided with a plurality of lateral slots for adjustability or positioning. A vertical axial motor 32 such as an air piston and cylinder or the like, is connected to the mounting bracket 31 and movably carries a vertical slide bracket 33. As shown, the piston of the motor 32 is immovably connected to the mounting bracket 31, while the slide bracket 33, is connected to move with motor cylinder having an up position adjustment and is provided with a pair of stabilizer slide rods 34, each being on a different side of the motor 32 and extending through an opening in the mounting bracket 31. The vertical slide bracket 33, to limit its downward travel, is provided with an adjustable stop 35 adapted to engage the mounting bracket 31.

A horizontal mounting bracket 36 is connected to the bottom of the vertical slide bracket 33, or may be made integral therewith. The cylinder of an axial motor 37 is mounted on the bracket 36 which is provided with a fixed stabilizer rod 38 on each side of the motor 37 having extension and retraction adjustments. A horizonntal slide bracket 39 is mounted on the slide rods 38 and is connected to be moved longitudinally (forwardly and rearwardly) by the piston of the motor 37. A pair of spaced fingers or guides 41 and 42 are connected to and extend forwardly from a mounting plate 40, which in turn, is connected to the horizontal slide block or bracket 39.

One of the fingers, in this instance, finger 41, is provided with a lateral slot (see FIG. 5) to permit lateral adjustment of the space between the fingers 41 and 42 while the other of the fingers, in this instance finger 42, is pivotally connected and is provided with a biasing spring 43. Both of the fingers 41 and 42 are provided with a stop 44 adapted to engage the edge of the pocket. It should be understood that the pivoting of finger 42 facilitates sliding the pocket over the fingers which laterally align the pocket while the effect of the bias of the spring 43 stretches the pocket opening out flat. The stops 44 longitudinally position the pocket edge.

The surfaces and edges of fingers 41 and 42 are preferably highly polished or suitably coated thereby creating low friction contact with a garment while the top surface of the feed plate is suitably roughened to provide a high friction contact surface.

In operation, initially the presser feet 25 and 27 are elevated or retracted while fingers 41 and 42 are elevated and in their forward position. A pocket is then slid on the fingers 41 and 42 until the pocket edge abuts both stops 44. Motor 32 is retracted moving the vertical slide 33 bracket downwardly until stop 35 abuts bracket 31 and the pocket is lowered on to, but not clamped against, the feed plate 21.

Motor 29 is now extended to rotate presser feet 25 and 27 which move downwardly clamping the pocket portion of the garment against the feed plate 21. The feed plate 21, presser feet 25 and 27, and fingers 41 and 42 are now positioned as shown in FIG. 5.

Motor 37 is now retracted which withdraws fingers 41 and 42 rearwardly out of the pocket and away from the sewing station. After tacking, motors 29, 32 and 37 are activated to return the presser feet 25 and 27, and fingers 41 and 42 to their initial positions.

Although but a single embodiment of the invention has been illustrated and described in detail, it is to be expressly understood that the invention is not limited thereto. Various changes may also be made in the design and arrangement of the parts without departing from the spirit and scope of the invention as the same will now be understood by those skilled in the art.

What is claimed is:

1. A method of simultaneously tacking both ends of a pocket opening with a twin needle tacker type sewing machine providing a sewing station, comprising the steps of providing guide means at the sewing station;

fitting a pocket on said guide means thereby positioning the ends of the pocket opening relative to the needles;

clamping the ends of the pocket openings in position and removing the guide means from the sewing station; and moving the clamping means and the pocket opening along longitudinal and lateral axes while simultaneously tacking both ends of the pocket opening.

2. The method in accordance with claim 1, further comprising the steps of releasing the pocket by said clamping means; and returning said guide means to said sewing station.

3. The method in accordance with claim 2, and providing a feed plate at the sewing station;

moving the pocket by said guide means on to the feed plate; and thereafter clamping the ends of the pocket opening against the feed plate.

4. In combination with a twin needle tacker type sewing machine providing a sewing station, apparatus for simultaneously tacking both ends of a pocket opening, comprising guide means disposed at the sewing station for receiving a pocket of a garment and positioning the ends of the pocket openings relative to the needles;

a feed plate disposed at the sewing station below said guide means;

means for moving said guide means to position the pocket on said feed plate;

means for clamping the ends of the pocket opening against the feed plate;

means for withdrawing said guide means from the pocket and away from the sewing station after the ends of the pocket opening are clamped; and means for moving said feed plate and clamping means with the pocket opening therebetween in unison along longitudinal and lateral axes while simultaneously tacking both ends of the pocket opening.

5. The apparatus in accordance with claim 4, and said guide means comprising a pair of laterally spaced fingers substantially parallel to each other extending forwardly above the feed plate for receiving a pocket;

said fingers being spaced to engage the ends of the pocket opening for lateral positioning relative to the needles;

said fingers each having a stop extending upwardly therefrom engaging the edge of the pocket thereby longitudinally positioning the ends of the pocket opening relative to said needles.

6. The apparatus in accordance with claim 5, and one of said fingers being pivotally mounted and spring biased to pivot away from the other of said fingers; and the other of said fingers being adjustably mounted to vary the lateral spacing between said fingers.

7. The apparatus in accordance with claim 6, and said guide means further comprising a mounting bracket releasably connected to said sewing machine; and means to laterally vary the position of said bracket relative to said sewing machine for laterally positioning said pair of fingers relative to said twin needles.

8. The apparatus in accordance with claim 7, and said guide means further comprising a bracket member connected to move relative to said mounting bracket;

a carrier connected to move relative to said bracket member;

said laterally spaced fingers being connected to said carrier;

first motor means for moving said bracket member vertically thereby moving said pair of fingers toward and away from said feed plate;

said motor means for moving said carrier longitudinally thereby moving said pair of fingers toward and away from said sewing station; and an adjustable stop to limit the downward movement of said bracket member and prevent said pair of fingers from clamping a pocket against said feed plate.

* * * * *